United States Patent [19]

Lamp

[11] 4,043,387

[45] Aug. 23, 1977

[54] WATER HEAT PIPE WITH IMPROVED COMPATABILITY

[75] Inventor: Thomas R. Lamp, Torrance, Calif.

[73] Assignee: Hughes Aircraft Company, Culver City, Calif.

[21] Appl. No.: 745,278

[22] Filed: Nov. 26, 1976

[51] Int. Cl.[2] ..... F28D 15/00
[52] U.S. Cl. ..... 165/105; 165/134
[58] Field of Search ..... 165/105, 134

[56] References Cited

U.S. PATENT DOCUMENTS

| | | | |
|---|---|---|---|
| 3,503,438 | 3/1970 | Geyer | 165/105 |
| 3,884,296 | 5/1975 | Basiulis | 165/105 X |

*Primary Examiner*—Albert W. Davis, Jr.
*Attorney, Agent, or Firm*—Lewis B. Sternfels; W. H. MacAllister

[57] ABSTRACT

Tantalum and like metals, when added to a water/ferrous metal heat pipe in the form of a foil, gauze or wire, acts as a hydrogen getter in order to counteract the otherwise incompatability of the heat pipe enclosure material with the water working fluid.

6 Claims, 6 Drawing Figures

WATER HEAT PIPE WITH IMPROVED COMPATABILITY

BACKGROUND OF THE INVENTION

1. Field of the Invention

The present invention relates to a water heat pipe with ferrous metal enclosure and, in particular, to improve compatibility, such as by counteracting the otherwise gas plugging action of hydrogen.

2. Description of the Prior Art

Heat pipes in which water is utilized as a working fluid have not been able to effectively utilize enclosure materials which react with the water to form gases, e.g., hydrogen. Such gases act as gas plugs and prevent normal operation of the heat pipe. Examples include iron-nickel type metals as stainless steel, carbon steel, and most nickel alloys.

SUMMARY OF THE INVENTION

It has been found that tantalum metal and similar metals such as titanium and niobium, when added to the above-type water heat pipe, act to prevent the deleterious action of hydrogen gas.

It is, therefore, an object of the present invention to provide for an otherwise incompatible water-metal heat pipe.

Another object is to provide for such a heat pipe in which hydrogen gas does not deleteriously affect the operation of the heat pipe to a significant degree.

Other aims and objects as well as a more complete understanding of the present invention will appear from the following explanation of exemplary embodiments and the accompanying drawings thereof.

DESCRIPTION OF THE PREFERRED EMBODIMENTS

Any of such hydrogen getter materials as tantalum, titanium and niobium metal is added to a water heat pipe having an enclosure of an iron-nickel type metal or alloy thereof. By "iron-nickel type metal" is meant any element which, when combined with water, will produce hydrogen gas and, therefore, it is not intended that iron and nickel be the only metals included in this class. By "getter" is meant any element or material which has an affinity for hydrogen and, at least, inhibits such production of hydrogen gas whether by prevention, collection or absorption, or otherwise. Examples of such getters include tantalum, titanium and niobium.

Figure 1:
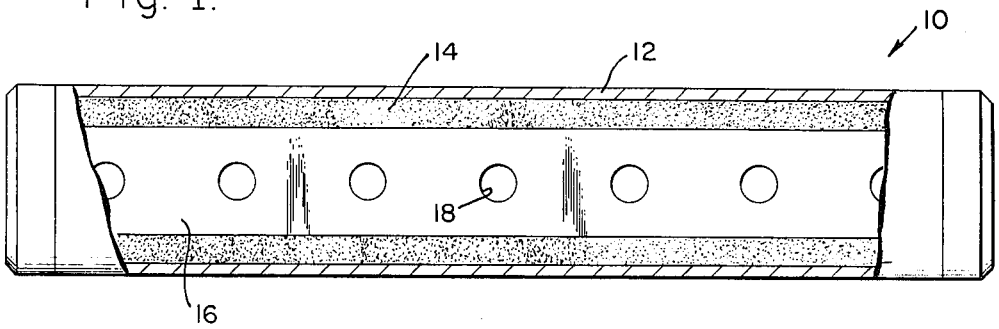
FIGS. 1, 3 and 5 depict alternate embodiments of the present invention, with FIGS. 2, 4 and 6 being respective cross-sections of FIGS. 1, 3 and 5 respectively taken along lines 2—2, 4—4, and 6—6 thereof.
Figure 2:
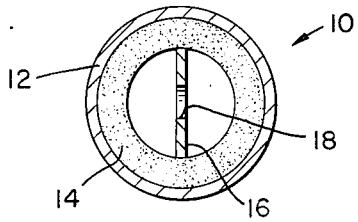

In FIG. 1, heat pipe 10 comprises an enclosure 12 of iron-nickel type metal or alloy thereof with a wick material 14 on its interior. Water is placed within enclosure 12 as a working fluid. In order to prevent generation of hydrogen gas which otherwise would occur when water and the material of enclosure 12 combine, a foil 16 of getter material, such as tantalum, titanium or niobium is placed. Holes 18 are placed within foil 16 to provide for vapor communication.

Figure 4:
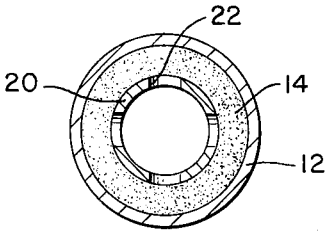
Figure 3:
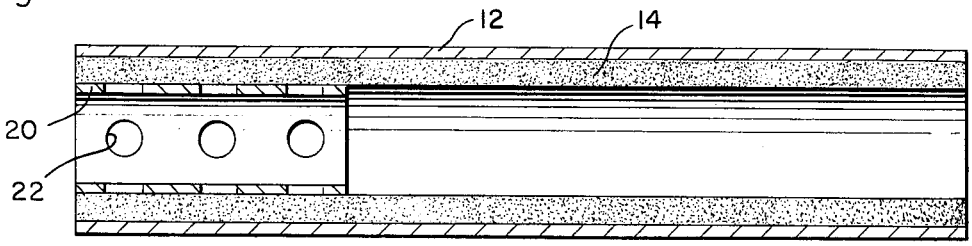

In FIGS. 3 and 4, the same enclosure materials are utilized; however, the getter comprises a cylinder 20, also with holes 22 therein for enabling vapor communication.

Figure 5:
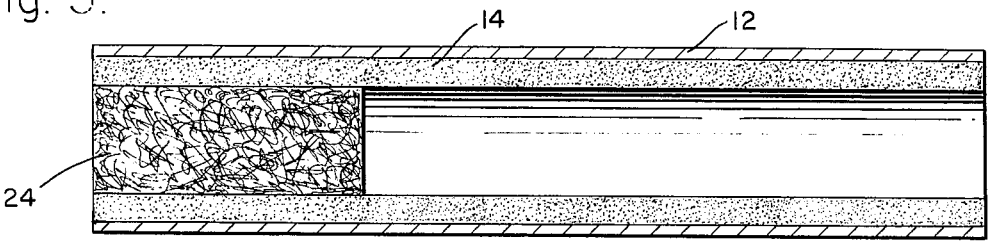
Figure 6:
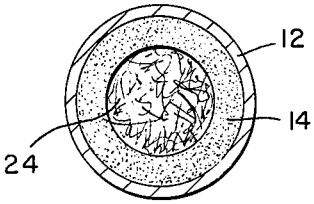

In FIGS. 5 and 6, the getter comprises fibrous material or powder, generally designated by indicium 24.

In one test, an enclosure comprising a particular stainless steel (SS 304) was constructed with a getter of tantalum. After six days of operation, the heat pipe temperature differential indicated that no hydrogen gas was present. In contradistinction to similar type heat pipes without a getter, considerable gas generation occured after only 24 hours of operation. It appeared that the getter absorbed the hydrogen gas and eventually was consumd; however, the precise chemical nature of the operation cannot be stated with certainty as not being fully understood at this time. It is certain, however, that the getter avoids the problems of incompatible combinations of water as the working fluid and certain metals as the enclosure material.

While specific means of placing the getter in the enclosure have been described, it is to be understood that any other means, e.g., vapor deposition onto the wick and/or wall, may be used.

Although the invention has been described with reference to particular embodiments thereof, it should be realized that various changes and modifications may be made therein without departing from the spirit and scope of the invention.

What is Claimed Is:

1. In a heat pipe including an enclosure and water as a working fluid in which the enclosure is formed of a material which combines with the water to generate hydrogen gas, the improvement comprising a getter selected from material having an affinity for hydrogen gas.

2. The heat pipe improvement as in claim 1 wherein said getter is tantalum, titanium or niobium.

3. The heat pipe improvement as in claim 1 wherein said getter comprises foil with holes therein for vapor communication.

4. The heat pipe improvement as in claim 1 wherein said getter comprises a cylinder with holes therein for vapor communication.

5. The heat pipe improvement as in claim 1 wherein said getter comprises particulate matter.

6. The heat pipe improvement as in claim 1 wherein said getter comprises fibrous material.

* * * * *